United States Patent [19]

Galecke

[11] 4,167,051

[45] Sep. 11, 1979

[54] BUOYANT LIFE JACKET

[75] Inventor: Robert A. Galecke, Mt. Prospect, Ill.

[73] Assignee: Ero Industries, Inc., Chicago, Ill.

[21] Appl. No.: 870,607

[22] Filed: Jan. 19, 1978

[51] Int. Cl.[2] ..... B63C 9/08

[52] U.S. Cl. ..... 9/329; 9/342

[58] Field of Search ..... 9/342, 14, 311, 329, 9/340, 341, 342

[56] References Cited

U.S. PATENT DOCUMENTS

| | | | |
|---|---|---|---|
| D. 203,250 | 12/1965 | O'Link | 68/123 |
| 1,623,993 | 4/1927 | Anderson | 9/342 |
| 2,563,966 | 8/1951 | Shaw | 9/342 |
| 2,807,035 | 9/1957 | Phillips | 9/342 |
| 3,266,070 | 8/1966 | O'Link | 9/342 |
| 3,383,722 | 5/1968 | LeBlanc | 9/338 |
| 3,570,030 | 3/1971 | Baker | 9/338 |
| 3,646,626 | 3/1972 | Frieder | 9/342 |
| 3,736,610 | 6/1973 | Frieder | 9/342 |
| 3,931,657 | 1/1976 | Jones | 9/342 |
| 3,956,786 | 5/1976 | O'Link | 9/345 |
| 3,988,795 | 11/1976 | Robertson | 9/338 |

*Primary Examiner*—Trygve M. Blix
*Assistant Examiner*—D. W. Keen

[57] ABSTRACT

A buoyant life jacket which embodies a pair of front and side sections, each of which includes a series of articulated fabric-covered buoyant panels, and a rear section which is composed of a lightweight open-mesh fabric which is connected to the front and side sections at the rear of the latter. A slide fastener interconnects the two front and side sections at the center thereof and extends from the neck opening at the top to the bottom of the life jacket at the front thereof. Securing means in the form of a pair of flexible cloth fastening straps and buckles are arranged at the bottom of the rear and open-mesh fabric section for securing the buoyant life jacket in position of use on the body of the wearer.

1 Claim, 5 Drawing Figures

BUOYANT LIFE JACKET

OBJECTS OF THE INVENTION

A primary object of the invention is to provide a new and improved buoyant life jacket which is lightweight, highly buoyant, and readily positioned on and removable from the body of the wearer, and is adapted for use in boating, sailing, water skiing and other water sports.

A further object of the invention is to provide a new and improved buoyant life jacket which embodies a novel construction and arrangement of a pair of buoyant front and side sections and an open-mesh lightweight fabric rear section which is interconnected to the front and side sections and which effectively reduces the weight of the new buoyant life jacket.

Other objects will appear hereinafter.

DESCRIPTION OF FIGURES IN THE DRAWINGS

DETAILED DESCRIPTION OF THE INVENTION AS SHOWN IN THE DRAWINGS

Figure 1:
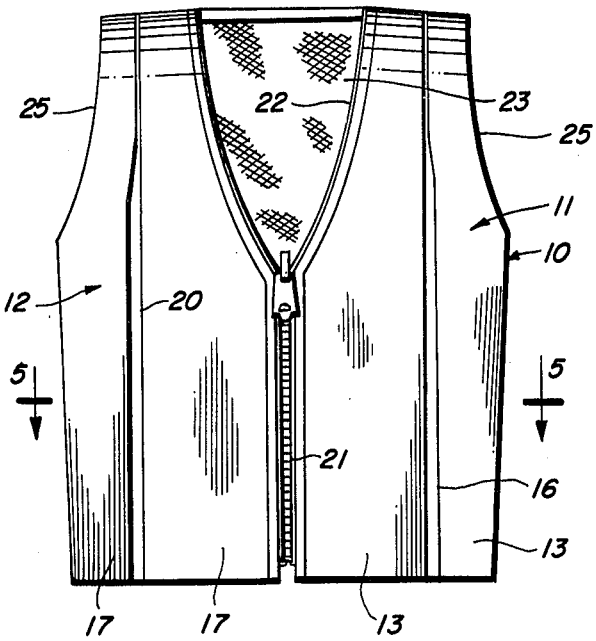
FIG. 1 is a front elevational view of a preferred embodiment of the new buoyant life jacket.

A preferred embodiment of the invention is illustrated in the drawings, wherein it is generally indicated at 10, and comprises a pair of front and side sections 11 and 12. The front and side section 11 includes a plurality of panels 13 (shown as three), each of which includes a shaped buoyant body member 14 which may be made of foam or other suitable buoyant material. Each of the buoyant body members 14 is enclosed within and is covered by an outer fabric cover 15, which may be made of canvas or other suitable fabric, and the panels 13 are articulated together vertically, as by stitching 16 of the outer fabric cover members 15 (FIG. 5).

Figure 5:
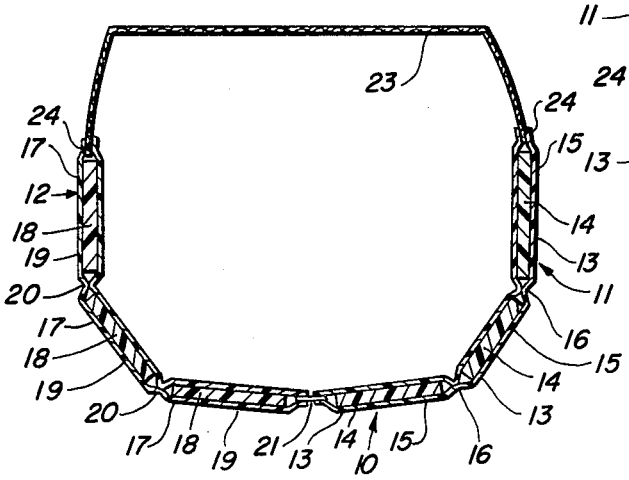
FIG. 5 is a sectional plan view on line 5—5 in FIG. 1.

Similarly, the front and side panel section 12 includes a plurality of panels 17 (shown as three) each of which includes a shaped buoyant body member 18 of foam or other suitable buoyant material, and an outer fabric casing 19 of canvas or other suitable material; the panels 17 being articulated together vertically as by stitching of the outer fabric covers 19, as at 20 (FIG. 5).

The front and side sections 11 and 12 are releasably fastened together at the front thereof by suitable fastening means, such as the slide or zipper fastening means 21, which extends from the bottom of the buoyant life jacket 10 to a neck opening 22 at the top thereof.

The new buoyant life jacket 10 includes a rear section 23 which is preferably formed of an open-mesh or similar lightweight fabric 23 which extends between the front and side sections 11 and 12 from the bottom thereof up to and around the neck opening 22 and has its outer side portions fastened to the fabric outer covers 15 and 19 of the rearmost panels 13 and 17 of the front and side sections 11 and 12, as by stitching 24 (FIG. 5).

Figure 2:
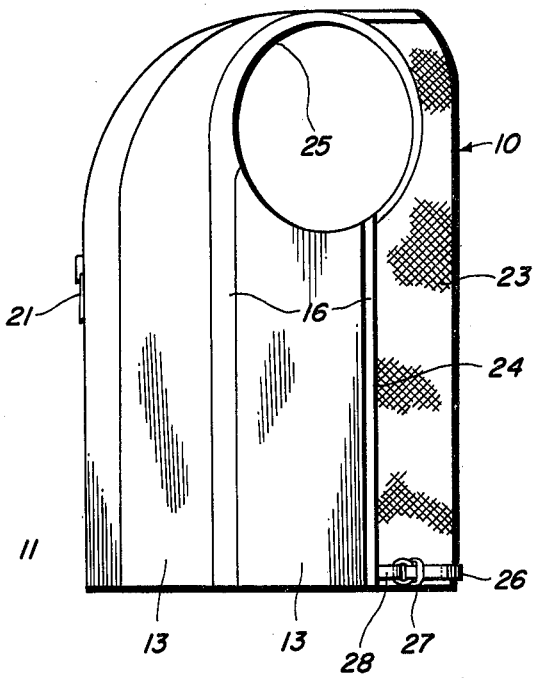
FIG. 2 is a side elevational view of the new buoyant life jacket as seen from the right hand side in FIG. 1.
Figure 3:
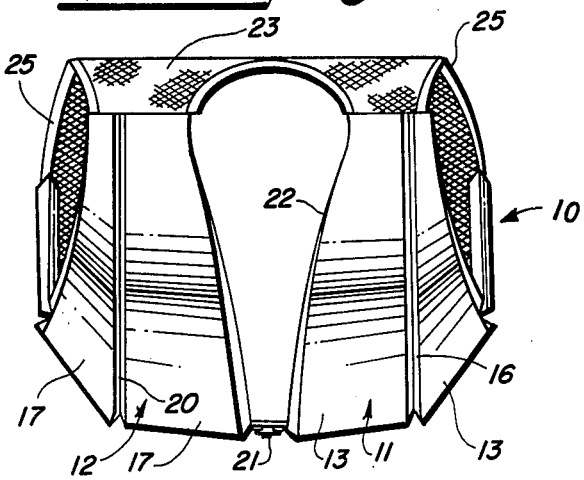
FIG. 3 is a top plan view.
Figure 4:
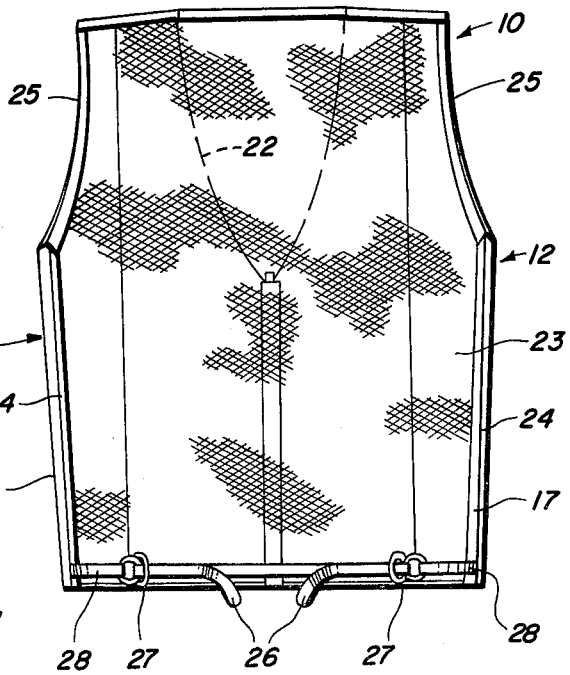
FIG. 4 is a rear elevational view.

As shown in the drawings, the new buoyant life jacket 10 has arm holes or openings 25 formed therein, and securing means in the form of flexible fabric fastening straps 26 and buckles 27 are attached, as by stitching as at 28, to the outer fabric covers 15 and 19 of the rearmost panels 13 and 17 of the front and side sections 11 and 12 at the bottom thereof; the fastening straps 26 extending across the back of the open-mesh fabric rear sections 23 at the bottom thereof (FIGS. 2 and 4).

A preferred form of the buoyant foam panels 17–18 is a unicellular polyethylene foam manufactured by Voltek, Inc. and also by Dow Chemical Co., or a polyvinylchloride foam manufactured by Uniroyal and sold under its trademark ENSOLITE.

A preferred form of the open-mesh rear lightweight fabric 23 is a polyester fabric, as made by various manufacturers of polyester fabrics.

In the use of the new buoyant life jacket 10 the slide fastening means 21 may be opened and the jacket 10 placed in position around the body or torso of the wearer with the wearer's arms extending through the arm holes or openings 25 and the wearer's neck extending through the neck opening. The new life jacket 10 may then be secured about the body or torso of the wearer by closing the slide fastening means 21 and tightening the fabric fastening straps 26—26 and buckles 27—27 so as to tighten the front and side sections 11 and 12 securely in position of use on the body or torso of the wearer.

It has been found that the new buoyant life jacket 10 is lightweight and comfortable in use and has adequate buoyancy while, at the same time, being substantially lighter than comparable prior buoyant life jackets by reason of the fact that it embodies the open-mesh rear fabric section 13 and thus eliminates the need for additional buoyant panels at the rear of the new life jacket.

It will thus be seen from the foregoing description, considered in conjunction with the accompanying drawing, that the present invention provides a new and improved buoyant life jacket which has the desirable advantages and characteristics and accomplishes its intended objects including those hereinbefore pointed out and others which are inherent in the invention.

I claim:

1. A buoyant life jacket comprising
   - (a) a pair of front and side sections each including
     - (1) a first buoyant front panel having
       - (a) an inner side edge portion; and
       - (b) an outer side edge portion;
     - (2) a second buoyant intermediate front and side panel each including
       - (a) a front edge portion articulated to the said outer side edge portion of one of the said first buoyant front panels; and
       - (b) a rear side edge portion;
     - (3) a third and rear buoyant side panel each including
       - (a) a lower end portion;
       - (b) a front edge portion articulated to the said rear edge portion of one of the said second buoyant intermediate front and side panels; and
       - (c) a rear edge portion;
     - (4) a flexible open-mesh rear fabric member extending completely across the back of the said buoyant life jacket and including
       - (a) a lower end portion;
       - (b) side edge portions articulated to the said rear edge portions of the said third and rear buoyant side panels;
       - (c) vertically extending slide fastener means releasably fastening the said inner edge portions of the said first buoyant front panels together at the front of said buoyant life jacket;

(5) the said first buoyant front panels having upper portions shaped and cooperating to provide (a) a neck opening in the said buoyant life jacket;

(6) the said second and buoyant intermediate front and side panels and the said third and rear buoyant side panels having upper end portions shaped and cooperating with each other and with the said flexible open-mesh rear fabric member to provide arm openings in the said buoyant life jacket; and (7) means including flexible fastening members extending across the said lower end portion of said flexible open-mesh rear fabric member outwardly thereof and having end portions attached to the said lower end portions of the said third and rear buoyant side panels for tightening the said buoyant life jacket about the body of the wearer.

* * * * *